United States Patent [19]

Geiger

[11] 4,206,879

[45] Jun. 10, 1980

[54] AGITATOR MILL

[75] Inventor: Armin Geiger, Wattwil, Switzerland

[73] Assignee: Gebrueder Buehler AG, Uzwil, Switzerland

[21] Appl. No.: 932,565

[22] Filed: Aug. 10, 1978

[51] Int. Cl.[2] ..... B02C 17/16

[52] U.S. Cl. ..... 241/46.11; 241/171; 241/172

[58] Field of Search ..... 241/46 B, 46.11, 46.06, 241/46.17, 170, 171, 172, 173

[56] References Cited

U.S. PATENT DOCUMENTS

| | | | |
|---|---|---|---|
| 1,676,389 | 7/1928 | Fletcher | 241/46 B X |
| 2,044,563 | 6/1936 | Carter | 241/46 B |
| 2,044,564 | 6/1936 | Carter | 241/46 B X |
| 2,414,964 | 1/1947 | McPherson | 241/46 B X |
| 2,496,359 | 2/1950 | Rymann | 241/46 B X |
| 3,533,566 | 10/1970 | Macquat | 241/153 |
| 3,888,427 | 6/1975 | Derouineau | 241/46.11 |

FOREIGN PATENT DOCUMENTS

| | | | |
|---|---|---|---|
| 1314789 | 4/1973 | United Kingdom | 241/172 |

*Primary Examiner*—Richard B. Lazarus

*Attorney, Agent, or Firm*—Merchant, Gould, Smith, Edell, Welter & Schmidt

[57] ABSTRACT

An agitator mill for continuous fine grinding and dispersion of solid constituents suspended in a liquid has a grinding container, an agitator mounted for rotation in the grinding container, a charge of grinding elements within the grinding container, an inlet into the grinding container for flow of grinding stock to the charge of grinding elements and an outlet from the grinding container for flow of grinding stock away from the charge of grinding elements, pressure means for the application of pressure to the charge of grinding elements to vary the volume of the charge of grinding elements, the agitator having a shaft for rotating it, a drive bearing in the region of one end of the grinding container to permit rotation to be applied to the shaft in the region of a drive end of the shaft and an end bearing for the other end of the shaft, the said end bearing being disposed within the charge of grinding elements. Entry separator means prevent the passage upstream of grinding elements and is disposed upstream of the end bearing. The end bearing may be surrounded by a bearing housing e.g. better to protect it from grinding elements or e.g. for ease of cooling or lubrication or centration etc.

16 Claims, 11 Drawing Figures

FIG. 5a
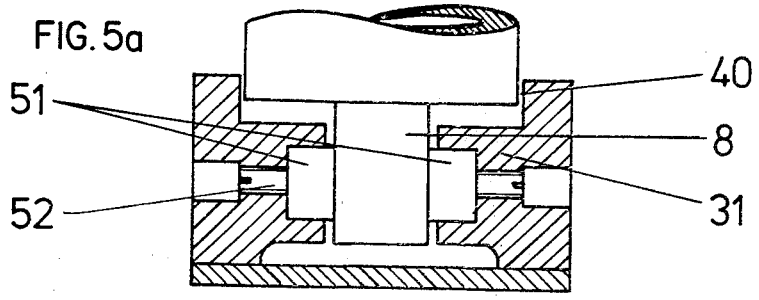
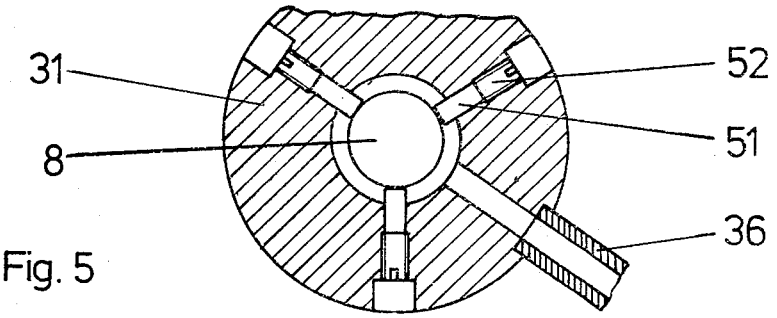
Fig. 5
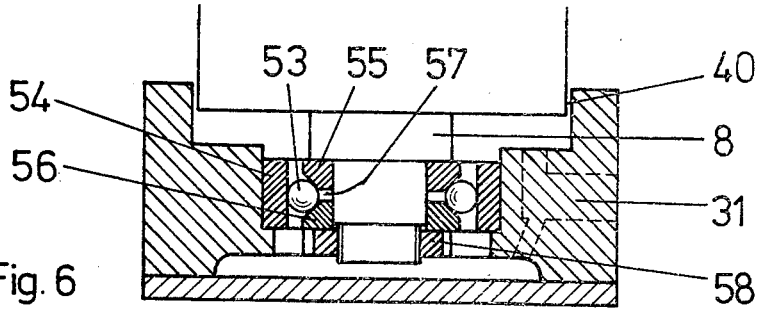
Fig. 6
Fig. 7
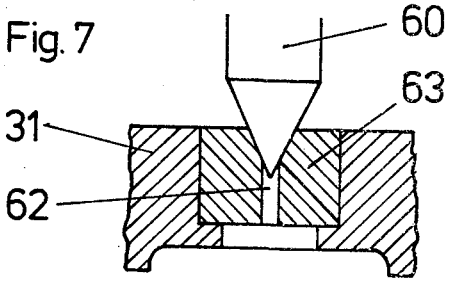
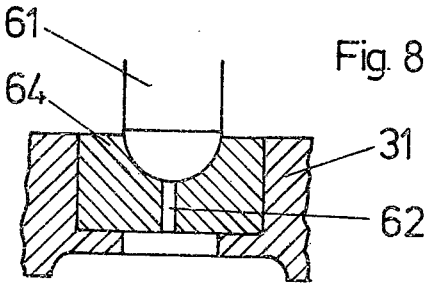
Fig. 8

AGITATOR MILL

FIELD OF THE INVENTION

The invention relates to an agitator mill for continuous grinding and dispersion of solid constituents suspended in a liquid comprising a preferably vertical grinding container charged with grinding elements and grinding stock and an agitator mounted for rotation in the grinding container.

STATEMENT OF PRIOR ART

Continuously operating agitator mills having a grinding container charged with grinding elements and grinding stock and a rotating agitator arranged therein to activate the container charge are known. They are generally constituted by vertically arranged relatively slender grinding containers partly charged with grinding elements, to which grinding stock is preferably pumped from beneath, in order to leave it again at the top after passing through a separator device that retains the grinding elements.

A grinding and dispersing effect is achieved by the activation of the container charge, in that an agitator mounted in the grinding container is set in rapid rotation. The agitator transmits its rotary movement by means of suitably formed agitator elements to the grinding elements, which by their respective high relative velocities subject the solid constituents of the grinding stock to powerful compression and shear forces.

The comminution effect and mill capacity depend inter alia very strongly upon the extent to which the grinding container is charged with grinding elements and upon the pressure to which the grinding stock is subjected in the grinding container.

Apparatuses to influence these two factors have therefore become known, which permit the working volume of the container content or the volume of the grinding element charge and the pressure to which the grinding elements are subjected to be modified. (DT-AS 1 248 440, DT-PS 2 051 003, DT-OS 2 240 751).

In the case of a rotary movement of the agitator in a loose bulk of grinding elements, a simple floating bearing of the agitator rotor above the grinding container is sufficient, and this is generally assembled with a seal and a coupling, belt pulley or the like to transmit the driving torque to the agitator. In this case special measures are adopted intended to prevent the shaft seal from being crushed due to vibration. (DT-AS 2 312 107, DT-OS 1 949 221).

More particularly for large mill units and with the container content subjected to pressure, a floating bearing of the agitator rotor is generally no longer sufficient if dangerous oscillations of the agitator shaft are to be avoided. Agitator bearings are known which employ an additional step or end bearing which may be located inside or outside the chamber through which the grinding stock flows. (CH-PS 459 724, DT-PS 1 272 689).

The advantage of a step bearing located in the grinding stock lies in the simplicity of the construction, because it manages without a seal with respect to the grinding stock chamber. The grinding stock is then used as a lubricant and flows through the bearing gap.

SHORT STATEMENT OF THE INVENTION

The present invention provides an agitator mill for continuous grinding and dispersion of solid constituents suspended in a liquid, comprising: a grinding container, an agitator mounted for rotation in the grinding container, a charge of grinding elements within the grinding container, an inlet into the grinding container for flow of grinding stock to the charge of grinding elements and an outlet from the grinding container for flow of grinding stock away from the charge of grinding elements, pressure means for the application of pressure to the charge of grinding elements to vary the volume of the charge of grinding elements, the agitator having a shaft for rotating it, a drive bearing in the region of one end of the grinding container to permit rotation to be applied to the shaft in the region of a drive end of the shaft and an end bearing for the other end of the shaft, the said end bearing being disposed within the charge of grinding elements.

By disposing the end bearing within the charge of grinding elements, it becomes possible to adopt a pressure device of the construction disclosed in DT-PS 2 051 003, which permits the grinding elements to be drawn off or pushed back from beneath the grinding space. This is in contrast to the disclosure in CH-PS 459 724 of a step bearing which is located outside a charge of grinding balls, in that there a grinding element separator device is incorporated above the bearing and the latter is in contact only with the entering grinding stock, but not with the grinding balls.

If the grinding container is vertical, the liquid grinding stock preferably flows through the grinding container from the bottom upwards, the end bearing receives and supports the bottom of the shaft, and the pressure means is at the bottom of the container to apply pressure to the charge of grinding elements from below.

Solutions are possible so that the separator means between the grinding stock and the grinding balls is constructed as a part of a displacement piston which has the function to enlarge or to reduce the volume of the grinding space. The separation gap is then arranged upstream of the end bearing considered in the direction of the inflowing grinding stock.

It is clear that the bearing gap and the matching of materials of bearing pin and bearing bushing must be adapted to the conditions within the grinding space, i.e. the bearing gap must be smaller than the smallest grinding element diameter. In order that even fragments of grinding elements which penetrate into the bearing gap cause no damage, pin and bushing must be harder than the grinding elements and the grinding stock particles. The bearing parts should therefore be made of hard metal or of materials coated with hard metal.

The end bearing disposed within the charge of grinding balls may also be surrounded by an end bearing housing which permits the influx of grinding stock as lubricant to the bearing but prevents any contact of the actual bearing parts, such as pin and bushing, with the surrounding charge of grinding elements.

Any danger that fragments of grinding elements may cause damage in the bearing gap is also eliminated by this construction.

The inlet separator means between grinding stock and the charge of grinding elements may in this construction be arranged downstream of the end bearing, considered in the flow direction of the inflowing grinding stock, despite the presence of a displacement piston, and is not combined with the displacement piston.

The separator means combined with the displacement piston consists of a radial gap between the piston wall and cylinder wall. The radial gap is interrupted at only a few places in order to guide the piston in the cylinder.

In another modified construction the piston end may be perforated by numerous holes which are smaller than the smallest grinding ball diameter, hence it does not allow the grinding balls to pass, but permits unobstructed influx of the grinding stock into the grinding space.

Several embodiments of the invention will now be described by way of example with reference to the accompanying drawings wherein:

BRIEF DESCRIPTION OF THE DRAWINGS

FIGS. 5 to 9 depict several modifications of the mountings of the pin in the step bearing.

DESCRIPTION OF PREFERRED EMBODIMENTS

Figures 1, 3:
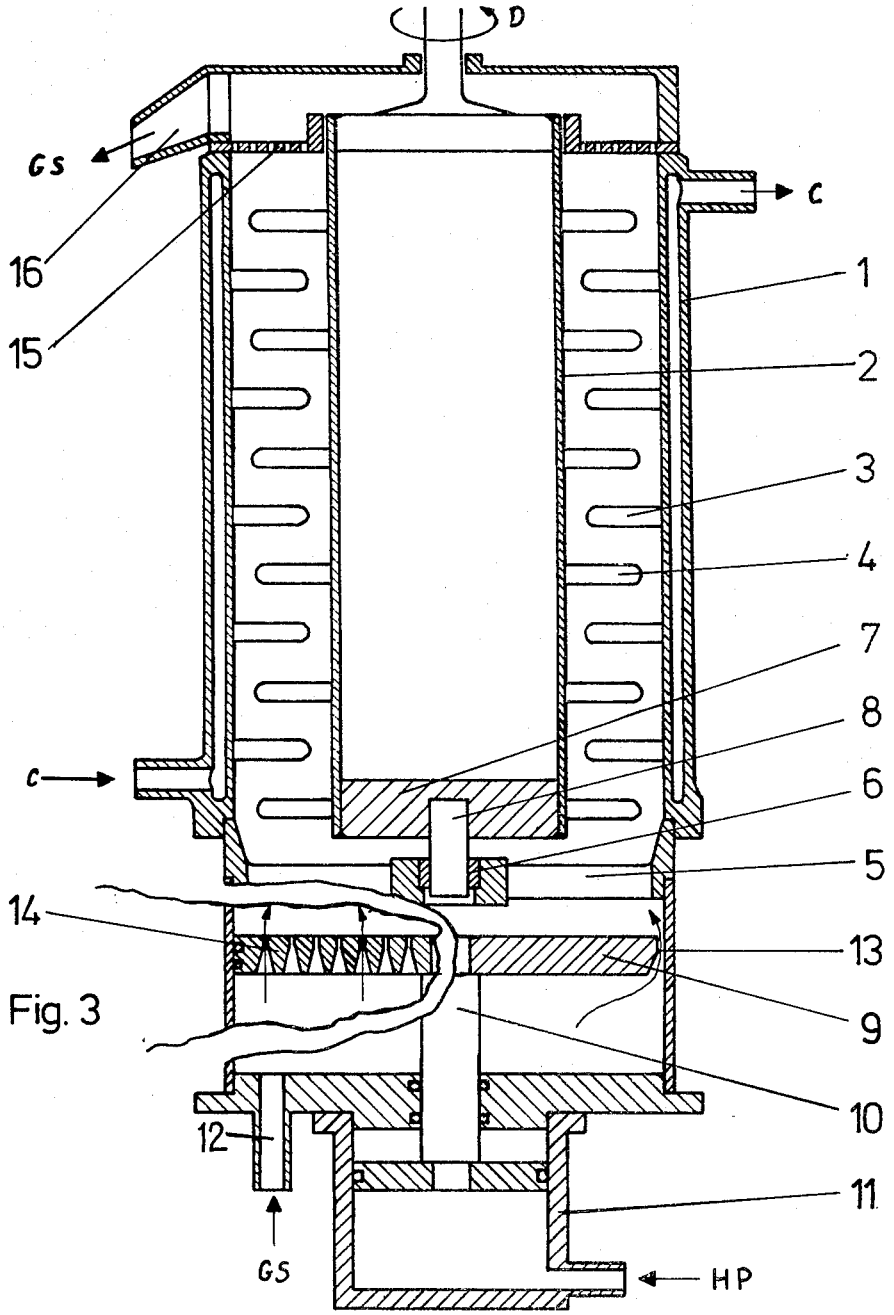
FIG. 1 is a longitudinal section through an agitator mill with a cylindrical step bearing and with a piston pressure means.

In the construction shown in FIG. 1, a grinding container (with cooling jacket for flow of coolant C) is designated 1, and an agitator rotor 2, both fitted with agitator elements 3 and 4 respectively.

The rotor 2 is set in rotation at the top at D through a drive motor-gear unit, not shown, and is additionally mounted for support in drive in a lower bearing spider 5. The bearing spider 5 is centred from its periphery in the grinding container 1 and carries in the centre a cylindrical bearing bushing 6 made of a hard material, e.g. hard metal. Let into the end plate 7 of the rotor 2 is a central cylindrical bearing pin 8 which slides at its other end in the bushing 6 and, like the bushing, is made of a very hard material, or to the surface of which great hardness has been imparted by special treatment. Obviously pin and bushing may also be arranged the other way about, i.e. the pin on the bearing spider and the bushing in the rotor.

Beneath the bearing spider 5 there is arranged in known manner a displacement piston 9 which is moved by the piston rod 10 also in known manner by a hydraulic until 11 (actuated by hydraulic pressure indicated at HP) or simply by a mechanical device. During downward movement a part of the grinding element charge is withdrawn from the grinding space in order to loosen it, whereas during upward movement the grinding element charge in the grinding space is compressed in order to increase the grinding intensity.

The grinding stock (indicated at GS) enters by way of the inlet opening 12 into the agitator mill under pump pressure, passes through the separator device in the form of a radial gap 13 combined with the displacement piston 9 or in the form of the axial sieve 14 shown in FIG. 3. These separator devices prevent the grinding elements from leaving the grinding space, because their passage orifices for the grinding stock are of smaller dimension than that of the grinding elements.

The grinding stock now travels through the grinding space from the bottom upwards and is simultaneously subjected to a comminution effect by frictional and shear forces by the grinding element charge set in motion by the rotating agitators 2 and 4. Before leaving the grinding space the grinding stock passes in the previously mentioned manner a further separator device, represented here as an axial sieve 15, and (again indicated at GS) leaves the agitator mill through the overflow orifice 16.

The novel feature of the arrangement of the step or end bearing within the grinding space within the charge of grinding elements is made possible in this construction by the adoption of hard metal for the bearing parts and the combination of the separator device with the displacement piston.

Figure 2:
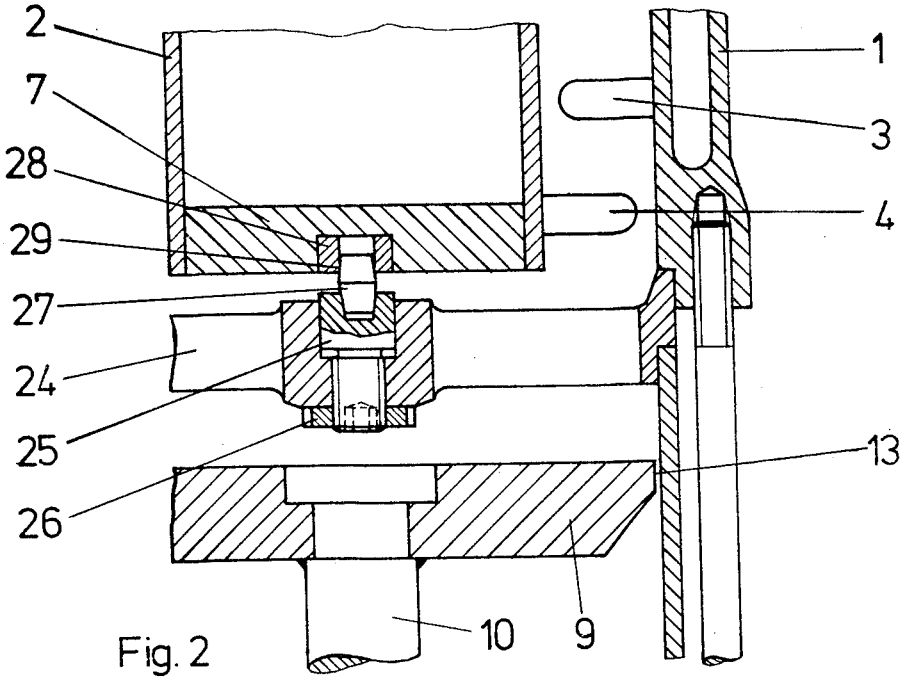
FIG. 2 illustrates a detail of a longitudinal section through an agitator mill with a conical adjustable step bearing and piston pressure means with radial gap separator device, FIG. 3 (which will be found in the lower left hand part of FIG. 1) illustrates a detail of a modified form of pressure piston with sieve separator means.

Another mode of bearing construction is shown in FIG. 2. The mill components designated by the same reference numerals as in FIG. 1 will not here be mentioned again specifically. The bearing spider 24 carries a rotatable screw threaded pin 25, which is adjustable in its longitudinal position by means of its screw thread when turned by engagement of its hexagonal socket, and is fixed in position by its locking nut 26. Let into the screw threaded pin 25 with cylindrical or conical seat is a bearing pin 27 which is made of very hard material, e.g. hard metal.

The bearing pin serves as centring means for the agitator rotor 2, in the end plate of which a bearing bushing 28 is embedded which slides with conical seat upon the likewise conical part of the bearing pin 27. The bearing bushing also consists of a very hard material.

By virtue of the longitudinal adjustability of the bearing pin 27 relative to the conical bearing seat in the bushing 28, the bearing gap 29 can be adjusted as desired. It is therefore a simple matter to make grinding stock enter the bearing gap as lubricating means, but on the other hand to choose a gap so narrow that no grinding elements penetrate it.

Fragments of grinding elements cannot cause any damage to the bearing if it is ensured that bearing pin and bushing have harder surfaces than the grinding elements.

Figure 4:
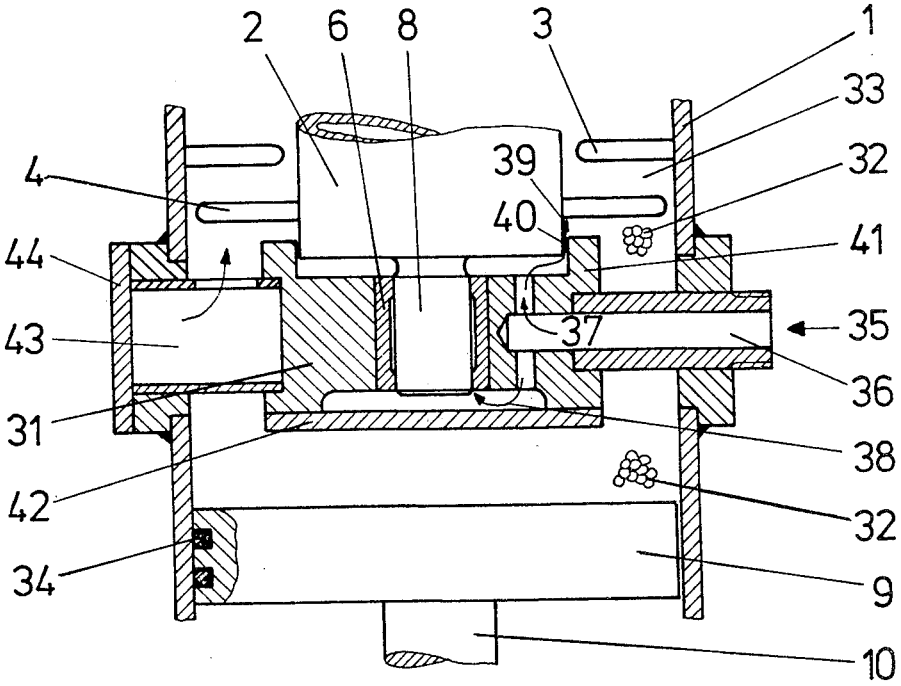
FIG. 4 shows a step bearing housing in longitudinal section with grinding stock feed and displacement piston.

The modified construction shown in FIG. 4 is particularly advantageous as regards the end bearing arrangement. The bearing bushing 6, which guides the bearing pin 8 of the agitator rotor 2 is here surrounded by a bearing housing 31 in order to shield the bearing parts from the grinding space 33 charged with grinding elements 32.

The displacement piston 9, arranged beneath the end bearing and actuated by the piston rod 10, makes it possible to enlarge or reduce the grinding space volume, or to exert greater or lesser pressure upon the charge of grinding elements. Here it no longer has the function of a separator device as in FIGS. 1 and 2, and may also be fitted with sealing rings 34 in case its underside is directly subjected to pressure medium. Here grinding stock enters at 35 and reaches the bearing housing by way of one of a plurality of radial channels 36 which are connected to the bearing housing 31 and also act as support arms. In the bearing housing the stream of grinding stock is divided in the direction of the arrows 37 and 38. The latter partial stream 38 flows as lubricating medium through the bearing gap between bushing 6 and pin 8 and unites with the partial stream 37 above the bearing and leaves the bearing housing in the direction of the arrow 39 through the separator gap 40 between the rotor 2 and the edge 41 of the bearing housing 31. The width of the separator gap 40 is chosen so that the grinding elements 32 cannot penetrate, but the grinding stock can emerge unobstructed. The underside of the space for the partial stream 38 is closed off by the screw-on cover 42. A charging channel 43 serves for the further supply of grinding elements and is closed by a cover 44.

Obviously, instead of the cylindrical bearing pin with bearing bushing illustrated in FIG. 4, further constructions can be envisaged which serve the same purpose of rotor guidance but are adjustable as regards bearing play.

Thus, FIG. 5 shows a radially adjustable bearing pin guide system in the housing 31 with three slide blocks 51 which can be presented towards the pin 8 by three set screws 52.

FIG. 6 shows a rolling-contact bearing with radial adjustability, in that bearing balls 53 roll upon the outer race 54 and are retained between two conical inner races 55 and 56. The bearing play can be adjusted by modifying the axial distance of the two inner races by means of different thickness of the shim 57, fixed by the shaft nut 58.

FIGS. 7 and 8 show possibilities of an axial adjustability of a conical pin 60 or a hemispherical pin 61 with central feed of the grinding stock as lubricating medium through the channel 62 into the correspondingly shaped bearing bushing 63,64.

Figure 9:
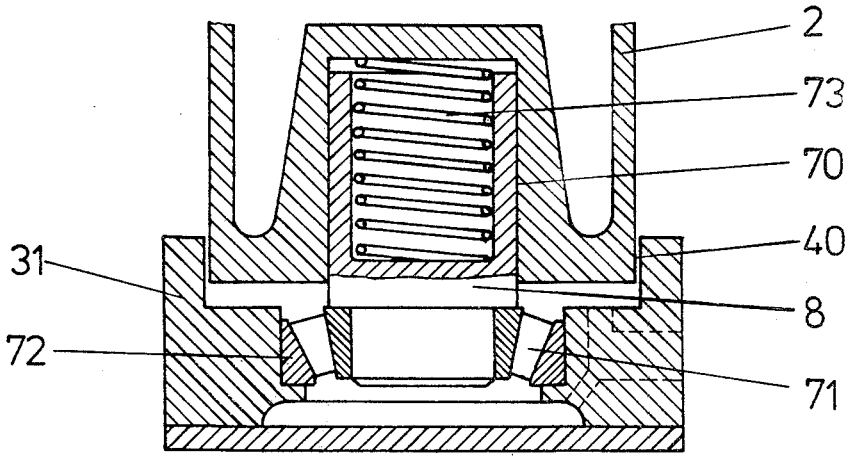

Obviously, normal customary commercial radial ball or conical roller bearings may be used with nonadjustable bearing play adjusted ready for installation, or with a spring pressure device according to FIG. 9, which automatically compensates all radial play which appears. In the rotor 2 on the end face a cylindrical pin 8 is let into a cylindrical sliding guide 70. On its end near the bearing it carries, for example, a customary commercial conical roller or oblique ball bearing 71, the outer race 72 of which is braced in the bearing housing 31. In a recess of the pin 8 is arranged a compression spring 73, the permanent axial thrust of which upon the rolling-contact bearing 71 automatically compensates any bearing play which develops.

Figure 10:
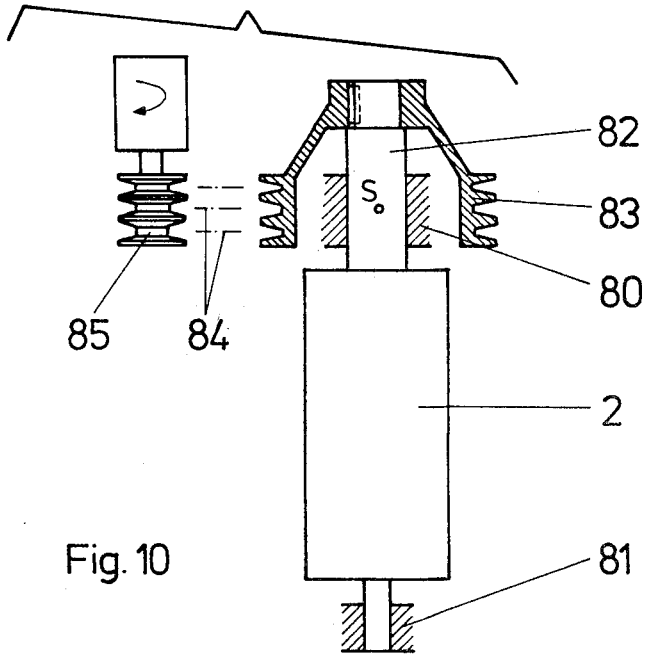
FIG. 10 is a schematic sketch of the drive end bearing of an agitator rotor.

The drive end bearing 80 and the foot end bearing 81 of an agitator rotor 2 are shown schematically in FIG. 10. In order to relieve the latter bearing largely from radial forces, the drive shaft 82 is advantageously protected from bending moments by being driven either through a shaft coupling, and hence stress only with a torque or in the case of the belt drive frequently employed, it is ensured that the belt line is oriented through the centre of reaction S of the bearing. A drive belt pulley 83 is keyed onto the drive shaft 82 in customary manner, but engages in pot-shaped conformation over the bearing 80 sufficiently to enable the V belts 84 indicated by chain-dotted lines from the motor-driven pulley 85 to the belt pulley 83 to be arranged symmetrically to the bearing's centre of reaction S.

The construction of the end bearing with a housing 31 surrounding it as shown in FIG. 4, also admits of advantageous solutions as regards bearing cooling or combination of cooling and lubrication. Thus e.g. the pin 8 may be constructed as a hollow body and carry a flow of cooling water from a cooled rotor 2.

If a partial stream 38 of the grinding stock flows through the bearing gap for lubricating purposes, the heat of friction evolved is then positively carried away from the bearing.

In a somewhat modified form of grinding stock feed 35 through the radial channel 36, it is conceivable to let the grinding stock flow only as a partial stream 37 direct into the separator gap, whilst blocking off the partial stream 38.

The bearing lubrication and cooling problem is the solved independently of the grinding stock channel 36 as a lubricating oil transverse stream, by two additional radial channels each having the function of an inlet or outlet channel of the bearing housing 31. In cases where bearing cooling does not appear necessary, a rolling-contact bearing with the customary grease lubrication may of course also be used in the bearing housing 31.

In FIG. 4, the radial channels 36 act as support arms for mounting the bearing housing 31 and simultaneously act as feed channels for the grinding stock or for the supply and discharge of bearing lubricating and cooling means. Similarly, the charging channel 43 for the further supply of grinding elements can also act as a support arm. These support arms have the same function at the side of the grinding space 33 as the stationary stator agitator elements 3 and are therefore conveniently made of wear-resistant material of circular cross-section.

I claim:

1. An agitator mill for continuous grinding and dispersion of solid constituents suspended in a liquid, comprising: a grinding container, an agitator mounted for rotation in the grinding container, a charge of discrete grinding elements within the grinding container, the agitator having agitator elements extending into the charge of grinding elements to set them in motion upon rotation of the agitator, an inlet into the grinding container for flow of grinding stock to the charge of grinding elements and an outlet from the grinding container for flow of grinding stock away from the charge of grinding elements, pressure means for the application of pressure to the charge of grinding elements to vary the volume of the charge of grinding elements, the agitator having a shaft for rotating it, the shaft having a drive end extending exteriorly of the grinding container from one end of the grinding container, a drive bearing in the region of the said one end of the grinding container to enable rotation to be applied to the shaft in the region of the drive end of the shaft, the shaft having a bearing end remote from said drive end and extending towards the pressure means, an end bearing for the bearing end of the shaft, support means for carrying the end bearing, said support means being fast with the grinding container, the said end bearing being disposed within the charge of grinding elements and spaced from the pressure means, and means for urging the pressure means towards the end bearing thereby to vary the volume of the charge of grinding elements.

2. Mill as claimed in claim 1 wherein the end bearing includes cylindrical sliding surfaces.

3. Mill as claimed in claim 1 wherein the end bearing includes conical sliding surfaces, and further comprising means for moving the said conical sliding surfaces towards and away from each other in the axial direction to permit adjustment of the bearing gap therebetween.

4. Mill as claimed in claim 1 wherein the pressure means includes a displacement piston for applying pressure to the charge of grinding elements, and further comprising entry separator means for preventing the passage upstream of grinding elements from the charge of grinding elements, the said entry separator means being disposed upstream of the end bearing and is combined with the said displacement piston.

5. Mill as claimed in claim 1 wherein the pressure means includes a displacement piston for applying pressure to the charge of grinding elements, and further comprising entry separator means for preventing the passage upstream of grinding elements from the charge of grinding elements, the said entry separator means being constituted by a radial gap at the periphery of the said displacement piston.

6. Mill as claimed in claim 1 wherein the pressure means includes a displacement piston for applying pressure to the charge of grinding elements, and further comprising entry separator means for preventing the passage upstream of grinding elements from the charge of grinding elements, the said entry separator means being constituted by sieve like passage apertures in the said displacement piston.

7. Mill as claimed in claim 1 further comprising an end bearing housing, the end bearing housing being disposed to surround the end bearing to prevent contact between the grinding elements and bearing parts of the end bearing.

8. Mill as claimed in claim 7 wherein the inlet into the grinding container includes an entry passage into the end bearing housing and the entry separator means is constituted at least in part by said end bearing housing, whereby grinding stock can enter the end bearing housing by way of said entry passage and leave it by way of said entry separator means.

9. Mill as claimed in claim 8 wherein the end bearing housing includes a plurality of flow passages for flow of grinding stock, at least one of said flow passages permitting flow of grinding stock between the bearing parts of the end bearing.

10. Mill as claimed in claim 8 wherein the end bearing housing comprises flow and return ports for the circulation therethrough of bearing cooling and lubricating medium independently of the flow of grinding stock.

11. Mill as claimed in claim 9 comprising a plurality of radial support arms, said support arms connecting said end bearing housing to the grinding container, said support arms having channels therein for the passage of at least one of the following viz: entry of grinding stock to the grinding container; flow and return of cooling and lubricating medium to and from the end bearing housing; charging and discharging of grinding elements to vary the charge.

12. Mill as claimed in claim 11 wherein the radial support arms are formed of wear resistant material of circular cross section.

13. Mill as claimed in claim 7 wherein the end bearing housing accommodates an end bearing selected from a group of bearings comprising cylindrical, conical and hemispherical plain bearings, radial and axial rolling-contact bearings, bearings with fixed play and bearings with adjustable bearing-play.

14. Mill as claimed in claim 7 wherein the end bearing housing accommodates an end bearing in the form of a radial plain bearing constituted by at least three sliding blocks of hard metal symmetrically disposed about the bearing axis and radially adjustable in position towards and away from that axis.

15. Mill as claimed in claim 7 wherein the end bearing housing accommodates an end bearing in the form of an axial rolling-contact bearing, and further comprising an axial compression spring mounted to exert thrust in the axial direction upon the rolling-contact bearing and thereby to take up any bearing-play.

16. Mill as claimed in claim 1 or claim 7 having a drive member in the region of the drive bearing, the drive member being adapted to be driven by belt means subjected to tension acting in a direction normal to the axis of the shaft, the drive means being positioned such that the resultant of the tension forces passes through a centre of reaction of the drive bearing.

* * * * *

UNITED STATES PATENT AND TRADEMARK OFFICE

CERTIFICATE OF CORRECTION

PATENT NO. : 4,206,879
DATED : June 10, 1980
INVENTOR(S) : Armin Geiger

It is certified that error appears in the above-identified patent and that said Letters Patent are hereby corrected as shown below:

Column 3, line 55, "until" should be --unit--.
Column 6, line 8, "the" should be --then--.

Signed and Sealed this

*Ninth* Day of *September 1980*

[SEAL]

*Attest:*

SIDNEY A. DIAMOND

*Attesting Officer*

*Commissioner of Patents and Trademarks*